US005931169A

United States Patent [19]

Kervoalen

[11] Patent Number: 5,931,169

[45] Date of Patent: Aug. 3, 1999

[54] MAKE-UP CASING WITH REMOVABLE CARTRIDGE

[75] Inventor: Christian Kervoalen, Paris, France

[73] Assignee: L'Oreal, Paris, France

[21] Appl. No.: 08/970,616

[22] Filed: Nov. 14, 1997

[30] Foreign Application Priority Data

Nov. 15, 1996 [FR] France ..... 96-13976

[51] Int. Cl.[6] ..... A45D 33/26

[52] U.S. Cl. ..... 132/294; 206/581; 206/823; 206/229; 220/740; 132/304; 132/315; 132/303

[58] Field of Search ..... 132/293, 294, 132/300, 301, 303, 304, 305, 314, 316, 317; 206/581, 823, 235, 229; 220/737, 740; 215/228; 248/146, 147, 153, 154, 313

[56] References Cited

U.S. PATENT DOCUMENTS

| | | | |
|---|---|---|---|
| 283,348 | 8/1883 | Jones | 248/147 |
| 513,125 | 1/1894 | Matthews | 248/313 |
| 2,113,095 | 4/1938 | Pomar | 248/147 |
| 2,353,363 | 7/1944 | Sanford | 248/313 |
| 2,458,329 | 1/1949 | Archer | 248/313 |
| 4,538,725 | 9/1985 | Glover et al. . | |
| 5,031,647 | 7/1991 | Seidler | 132/317 |

FOREIGN PATENT DOCUMENTS

| | | |
|---|---|---|
| 2686784 | 8/1993 | France . |
| 08 238123 | 9/1996 | Japan . |

*Primary Examiner*—Todd E. Manahan
*Assistant Examiner*—Eduardo C. Robert
*Attorney, Agent, or Firm*—Oblon, Spivak, McClelland, Maier & Neustadt, P.C.

[57] ABSTRACT

A casing (100) of the make-up compact-type includes a bottom (101) and a lid (102), the compact bottom (105, 106) receiving in a detachable manner a refill (1) of a product (P) to be packaged. For this purpose, it has at least one arm (105, 106) having a free end (1050, 1060), the arm or arms delimiting, together with the bottom, a cutout (107) in a shape complementary to the shape of the refill (1). A mouth (130) of the cut out 107 is delimited, at least partly, by the free end of the arm or arms. The arm or arms deflect by elastic deformation to allow the refill (1) to be introduced into the cutout (107) through the mouth (130), and close again on the refill (1) so as to hold it tight over at least a portion of its peripheral edge and to hold it in position in the compact (100).

30 Claims, 6 Drawing Sheets

1
2
8
10
16
18
24
36
50
101
102
103
104
108
109
111
112
113
114
115
116
A
P

MAKE-UP CASING WITH REMOVABLE CARTRIDGE

BACKGROUND OF THE INVENTION

1. Field of the Invention

The present invention relates to a casing for packaging and presentation, in particular of a friable product in the form of a solid or semisolid block. Generally this product is a make-up product, also termed a "loaf" or "cake". This product may be positioned in a compact by casting the product in its liquefied state, which is transformed after solidification into a solid and friable product capable of being taken up for use using a finger, a puff or brush. More particularly, the product aimed at by the invention is a cheek blusher, an eye shadow or a foundation cream. More particularly, the product is contained in a refill mounted in the compact in a detachable manner. The invention applies generally to any product in a powdery or pasty, solid or semi-solid form.

2. Description of the Related Art

It is known make refillable casings of the make-up compact type which comprise a hollow bottom whereon a lid is articulated. Inside the hollow bottom, there are disposed one or more removable pans containing, for example make-up products of different colors.

By way of example, FR-A-2 585 935 describes a refillable compact capable of receiving at least one solid product block and comprising a manipulating element of a lever mechanism type to allow the block or blocks to be extracted for replacement. One of the problems of such a device is its complexity and hence its relatively high manufacturing cost, as well as to its fragility, in particular after multiple use.

FR-A-2 719 981 describes a packaging unit for at least one product of a solid or semisolid consistency, comprising elastic holder permitting the extraction of a refill and the positioning of a new refill. A compact of this type is described in U.S. Pat. No. 4,538,725.

EP-A-0081901 describes a make-up compact having therein a plurality of shallow dishes for cosmetic products, the bottom of each dish being provided with a magnet capable of cooperating with a magnetic material forming the bottom of the compact so as to keep the dishes in position inside the compact. Such a mounting system is expensive and not convenient to use.

Other examples of refillable compacts are described in FR-A-0 956 387, FR-A-2 471 326, FR-A-2 511 233, FR-A-2 488 109 and FR-A-2 686 784. These patents also describe complicated and expensive mechanisms for the mounting of the refill or refills in a detachable manner.

Another problem common to these known devices is due to the fact that when the user wishes to change the product in the compact by changing the pan, it is necessary to wait until all the product in the pan has been used up. Also, once the pan has been removed from the compact, the problem of packaging and carrying it arises, which in general takes the form of a simple hollow receptacle of shallow depth. The refill pans generally have, at the time of their sale, a heat-sealed cover which cannot be reused for subsequently reclosing the pan. Thus, once removed, the pan can only be carried with difficulty in a handbag without the risk of an inopportune fouling of the contents of the bag. Also, due to evaporation of the solvent, the preservation of the product is precarious.

Finally, there also arises the problem of the removable locking of the lid on the bottom. Typically, the casings of the make-up compact type generally have a lid articulated on the bottom around an axis of articulation. Generally, closing means are disposed so as to ensure the removable locking of the casing lid on the casing bottom in the region of the end of the compact on the opposite side to the axis of articulation. A major problem occurring in the case of inexpensive compacts is due to the fact that the articulation mechanism is fragile and largely loses its efficiency during use. The problem is accentuated by the fact that the current tendency of the market is to incorporate an increasing number of accessories in the compacts, which is in generally achieved by increasing the size of the compact and therefore by increasing the distance between the axis of articulation and the closing mechanism. This produces a lack of precision that is so much greater in the positioning of the "male" part of the closing system (generally carried by the compact lid) and the female part (generally carried by the compact bottom).

The problem is even more critical when a part of the compact is detachable. Indeed, because of the play in mounting the detachable part on the rest of the compact, it is difficult to have a correct relative positioning of the respective elements of the closing system. Moreover the fact that the assembly play increases in the course of use produces a substantial reduction in the precision of the closing system, quickly making its efficiency inadequate.

SUMMARY OF THE INVENTION

Thus it is an object of the present invention to make a casing, in particular for a make-up product, which lacks the conventional drawbacks mentioned.

It is a further object of the invention to provide a refillable casing of the make-up compact type in which mounting/dismounting of the refill in the compact is simple, economical and reliable.

Another object of the present invention is to provide a compact having a removable refill of the product, so as to allow the product in the compartment to be changed in the course of its use without appreciably affecting the preservation of the packaged product.

It is another object of the present invention to provide a compact of a refillable or non-refillable type which has a pleasing appearance, is easy and economical to make, and whose closing system substantially retains all its precision and efficiency in the course of use. Yet another object of the invention is to make a refillable compact comprising a bottom and a lid articulated on the bottom, and whose refill is capable of receiving an auxiliary lid, so as to be used independently of the compact.

Other objects will become apparent in a detailed manner in the following description.

In accordance with a first aspect of the invention, these objects are attained by a make-up casing comprising a lid, and a bottom associated with the lid, the bottom having at least one elastically deformable arm disposed substantially parallel to a plane of the bottom and delimiting, together with the bottom, a cutout in a shape complementary to the shape of the refill, the cutout having a mouth at least partly delimited by a free end of the at least one arm, so that a refill can be introduced into the cutout through the mouth and can be detachably held in the cutout over at least a portion of a peripheral edge thereof by the resilience of the at least one arm.

Advantageously, the cutout has an internal edge defining a groove capable of cooperating with the rib of the peripheral edge of the refill. The groove is delimited by an upper edge and a lower edge which are parallel to one another and are connected by a bottom. The upper edge advantageously forms a rib capable of cooperating with a groove formed by the peripheral edge of the refill.

By way of example, the refill has a circular shape, the portion of the peripheral edge delimiting an angle of from 190° to 210°, and preferably from 195° to 205°.

The refill may comprise closing means capable of cooperating with complementary means of a detachable auxiliary cap for covering the refill. The closing means may comprise a thread capable of cooperating with a corresponding thread carried by the auxiliary cap.

Preferably, the lid is articulated on the bottom around an axis of articulation, the bottom having, at its end remote from the axis of articulation, two arms substantially in the extension of the bottom, and orientated in a manner substantially perpendicular to the axis of articulation.

According to another aspect of the invention, there is provided a compact comprising a bottom capable of receiving the packaged product, a lid articulated on the bottom around an axis of articulation and closing means for locking the lid on the bottom in a removable manner. In the closed position of the compact lid on the compact bottom, the product is wholly or partly contained beyond the closing means relative to the articulation axis X. The receiving means may be constituted by a removable refill-type compact.

Advantageously, the closing system is arranged so that, in the closed position of the lid on the bottom, the closing means are situated between the receiving means and the axis of articulation. Advantageously, the bottom has a longitudinal axis parallel to a plane of the bottom of the compact, and perpendicular to the axis of articulation. In the closed position of the lid on the bottom, the closing means is substantially in the longitudinal axis. The closing means may comprise a tab carried by the lid and directed substantially perpendicularly to the surface of the lid, the tab having a flange capable of cooperating, by elastic deformation of the tab, with a complementary element carried by the bottom of the compact so as to lock the lid on the bottom in a detachable manner.

Alternatively, the compact has two lateral edges substantially perpendicular to the axis of articulation, the closing means being situated on, or in the vicinity of, at least one of the lateral edges of the compact. The compact may, moreover, be wholly or partly made of a translucent material.

The packaged product may be a cheek blusher, an eye shadow, a foundation cream etc. Advantageously, the product contains hydrated gypsum ($CaSO_4 \cdot 2H_2O$).

BRIEF DESCRIPTION OF THE DRAWINGS

In the description that follows reference will be made, by way of a purely illustrative and in no way restrictive example, to the drawings illustrating some preferred embodiments of the invention, and wherein.

DETAILED DESCRIPTION OF THE PREFERRED EMBODIMENTS

Figure 1:
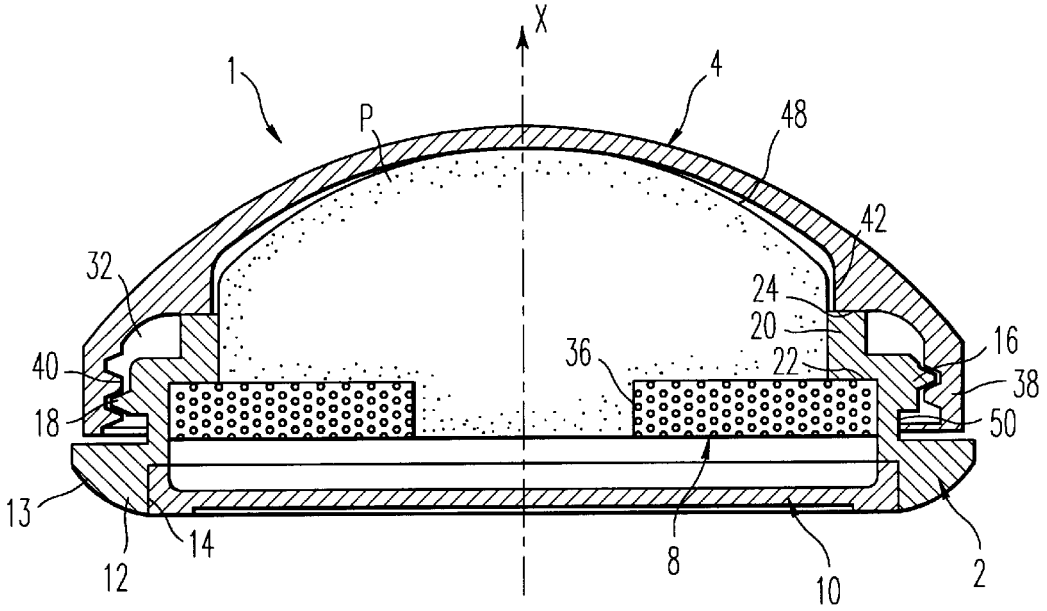
FIGS. 1 and 2 illustrate an embodiment of a refill that can be mounted in a detachable manner in the compact in accordance with the invention.

FIG. 1, to which reference will now be made, illustrates an embodiment of a cartridge or refill that can be mounted in a detachable manner in the compact in accordance with the invention. The refill 1 contains a solid, friable product P, such as a cheek blusher, and has an axis of symmetry X, a bottom 2 defining a receptacle surmounted by a preferably transparent screw-on lid 4, a ring 8 of cellular foam and a stopper 10. The bottom 2 is annular and comprises a base 12 provided with a large central opening 14 into which the stopper 10 is inserted.

On its side nearest the bottom 2, the circumference 13 of the base 12 is rounded off substantially in a quadrant shape. On the side remote from the bottom, the base has a short cylindrical portion 16 with a diameter smaller than that of the base 12, this portion 16 having an external thread 18 serving to fix the screw-on lid 4. To the portion 16 there is joined a cylindrical skirt 20 whose diameter is smaller than that of the portion 16, thereby forming an internal setback 32. The skirt 20 has a free end 24. Together with the bottom 2, the cylindrical portion 16 forms an annular groove 50 which, as will be described in greater detail below, is capable of receiving an annular rib formed by the fastening edge of a compact in which the refill 1 is intended to be mounted in a detachable manner. The bottom 2 itself forms an annular rib capable of cooperating with an annular groove formed in the fastening edge of the compact.

Inside the receptacle formed by the bottom 2 is the ring 8 having a central opening 36. In this embodiment, the opening 14 of the bottom and the opening 36 of the ring 8 form an opening for the intake of the product P. The ring 8 extends radially as far as the cylindrical portion 16 and is held in position beneath the setback 32, where it is fixed by thermal welding. The ring 8 is made of an open cell cellular foam, for example an elastically compressible polyethylene foam. It forms the means for fastening the block of the product P. It may also be joined to the bottom 2 by bonding or by any other suitable means.

The lid 4 is dome-shaped and is molded from a preferably transparent material. Polystyrene may be used, for example. It has a cylindrical side wall 38, provided on its inside with a thread capable of cooperating with the thread 18 of the base 12. The lid 4 has, moreover, an annular internal projection 42, capable of coming to bear against the edge 24 of the skirt 20 when the lid is fixed on the base 12.

The filling of the refill may be effected by compacting or casting an appropriate quantity of the product P in its liquefied state through the intake openings 14, 36 if the inverted device while the lid 4 forms a bottom, thus imparting to the product the dome shape of the lid. Alternatively a thermoplastic transparent cover (not shown) formed in the shape of the dome is used to form a bottom during the casting of the product. The liquefied make-up product may be in the form of a paste obtained by mixing a solid particulate phase either with an aqueous phase or with a binder, in particular a fatty phase in a solvent; it may also be in the form of a product with a base of thermofusible waxes, or it may be a gel which is cast in its hot state. According to the type of composition chosen, the solidification is thus effected by the evaporation of water or a solvent, by cooling or by a chemical reaction. An example of the process of filling such a refill is, for example, described in EP-A-0 628 393.

Figure 2:
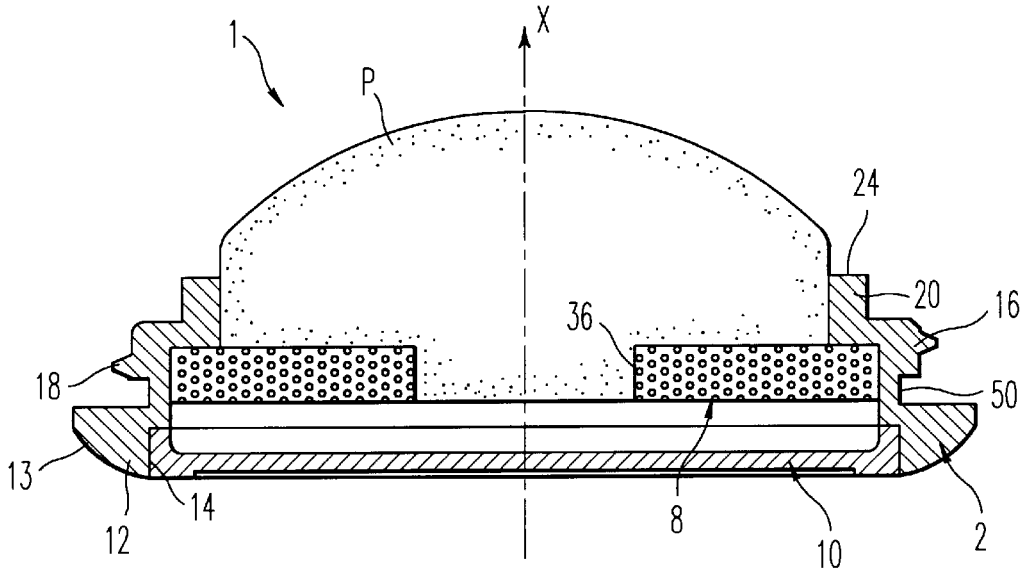

As shown in FIG. 1, the refill 1 and lid 4 form a compact as an integral part capable of being sold, used and carried in a completely independent way. As will be seen in greater detail below, this refill can be mounted in a detachable manner in a more sophisticated compact. Preferably, when such a compact is assembled, the lid 4 is taken off. The refill 1 is then as shown in FIG. 2. Alternatively, a cover may be disposed on the surface of the product but will then be removed, if applicable, by the user during the first use.

Figure 3:
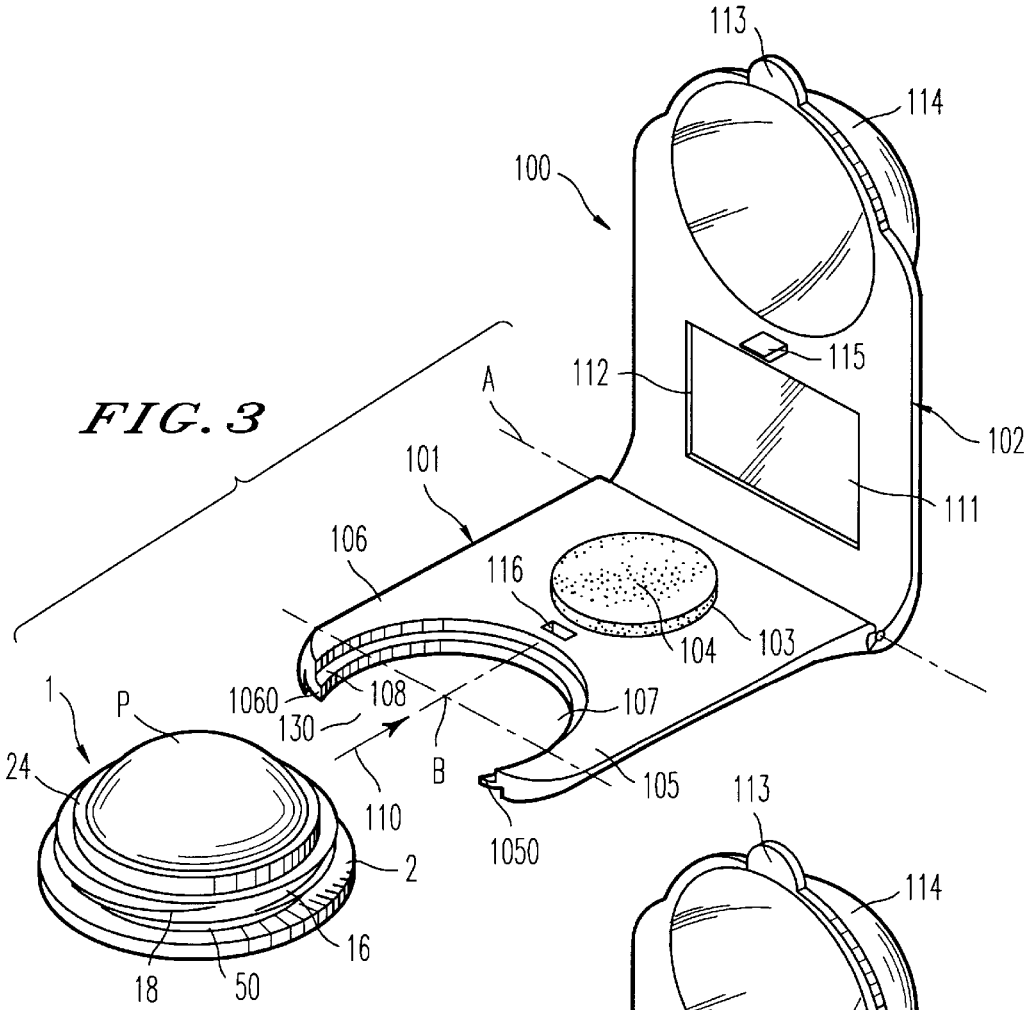
FIGS. 3 to 5 illustrate a first embodiment of a compact in accordance with the invention, wherein there is mounted a refill in accordance with FIGS. 1 and 2, FIGS. 6 and 7 illustrate a second embodiment of a compact in accordance with the invention, wherein there is mounted a refill in accordance with FIGS. 1 and 2.

FIG. 3 shows a first embodiment of a compact 100 in accordance with the invention. It comprises in the main a bottom 101 whereon a lid 102 is mounted in an articulated manner around an axis of articulation A. Advantageously, the unit is made of a translucent plastic material such as, for example, ABS (a copolymer of acrylonitrile/butadiene/styrene). The bottom has a first recess 103 for receiving an applicator such as a puff 104. At its end on the side remote from the axis of articulation A the bottom 101 forms two arms 105, 106 extending substantially in the plane of the bottom 101 and orientated substantially perpendicularly to the articulation axis. The free end of the arms 105, 106 delimit an opening 130 for allowing the refill to be introduced into the cutout. Together with the bottom 101, the arms 105 and 106 form a circular arc-shaped cutout 107. In the case of a refill with a circular shape, the angle delimited by the cutout is preferably slightly greater than 180° so as to allow the refill to be inserted into the cutout only by elastic deformation of the free end of the arms. The arms then close again under the effect of the resilient restoring force so as to hold the refill 1 tightly over at least half its circumference. Typically this angle is from 190° to 210°, and is preferably from 195° to 205°. In actual fact, the angle is chosen in an appropriate manner according to the resilience of the material constituting the arms 105, 106.

Figure 5:
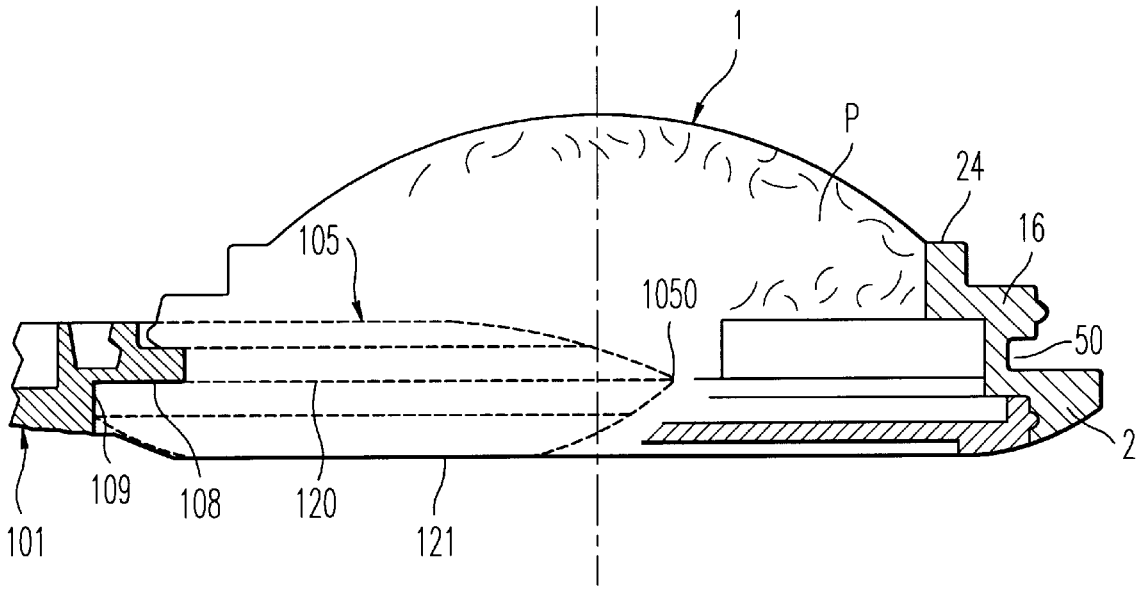

FIG. 5 illustrates in detail the mounting of the refill in the compact. The internal edge of the cut out 107 delimited by the arms 105, 106 and the bottom has a groove 109 delimited by the continuous lower edge 120 of a rib 108 and by a circular arc-shaped edge 121. According to a particular embodiment, the arc-shaped edge 121 is not continuous over the whole periphery of the cutout. The groove 109 has an internal diameter (at the bottom of the groove) substantially equal to (preferably slightly greater than) the external diameter of the edge 2 of the refill. The groove 109 has an axial height (between 120 and 121) slightly greater than the height of the edge of the bottom 2 so that the bottom can be inserted in the groove 109. The rib 108 has an axial height slightly smaller than the axial height of the groove 50 of the refill, and an external diameter substantially equal to (preferably slightly smaller than) the diameter of the bottom of the groove 50. Thus the rib 108 can be inserted in the groove 50. As shown in FIG. 5, the arms 105 and 106 have a tapered shape at their end 1050 so as to facilitate the insertion of the refill 1 in the compact.

Figure 4:
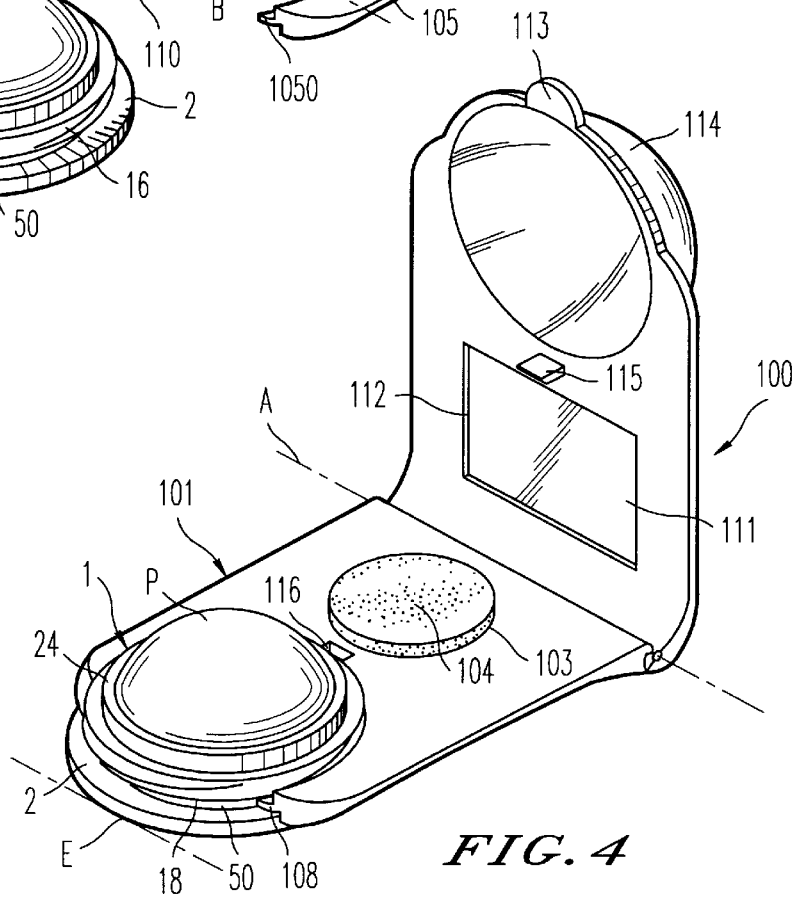

For mounting the refill in the compact 100, the refill is introduced into the compact by causing it to slide in the direction of arrow 110 in FIG. 3. This produces a divergence of the arms 105, 106 by elastic deformation. The maximum deformation is reached during the passing of the greatest width of the refill into the mouth 130 of the cut out 107. After the passing of this point of maximum deformation, the arms elastically reassume their initial position and close over the body of the refill, the rib 108 being positioned in the groove 50 and the edge 2 of the refill being in the groove 109 of the compact. This position is illustrated in FIG. 4. The thread 18, intended for the mounting of an auxiliary lid on the refill 1 when the refill is used separately from the compact, is situated above the rib 108. The removal of the refill is effected by drawing the refill in the opposite direction to the arrow 110. Thus the mounting and dismounting of the refill are effected in a simple manner. The refill is held perfectly in position in the compact, thanks to the arms 105, 106 and to the cooperation of the groove/rib devices. Such a design has a low production cost.

The lid 102 articulated on the bottom 101 has, moreover, a recess 112 capable of receiving a mirror 111. In the case where the compact is made of a translucent material, the mirror is advantageously has two reflecting sides. The mounting of the mirror on the lid may be effected by any known means, such as bonding or welding. However, the mirror is advantageously mounted by snap fitting. This technique consists of folding back an edge in its hot state over at least a portion of the periphery of the mirror.

The end of the lid on the side remote from the articulation axis A defines a dome-shaped portion 114 of a shape complementary to that of the product P in the recess. A tongue 113 is disposed at the end of the lid, so as to facilitate the opening of the compact.

The compact in accordance with the invention also comprises closing means capable of locking the lid on the bottom 101 in a removable manner. These closing means have complementary latch elements including a first element 115 carried by the lid and capable of cooperating with a complementary element 116 provided in the bottom of the compact. The closing mechanism will be described in greater detail with reference to FIG. 11. In the embodiment of FIGS. 3 and 4, the closing means are situated substantially in the longitudinal axis B of the compact, parallel to the plane of the bottom of the compact and perpendicular to the articulation axis A.

According to a preferred characteristic of the invention, the closing means 115, 116 are disposed so that in the closed position of the lid on the bottom, the closing means are situated between the axis of articulation and the refill 1. Thus the product P is completely contained beyond the closing means relative to the articulation axis A. This characteristic, which contributes to reducing the distance between the axis of articulation and the closing system, is particularly advantageous for compacts of the detachable refill type, makes it possible to reduce substantially the impact on the accuracy and efficiency of the closing system due to the play in the mounting of the articulation and to the detachable assembly of the refill in the compact.

Figure 6:
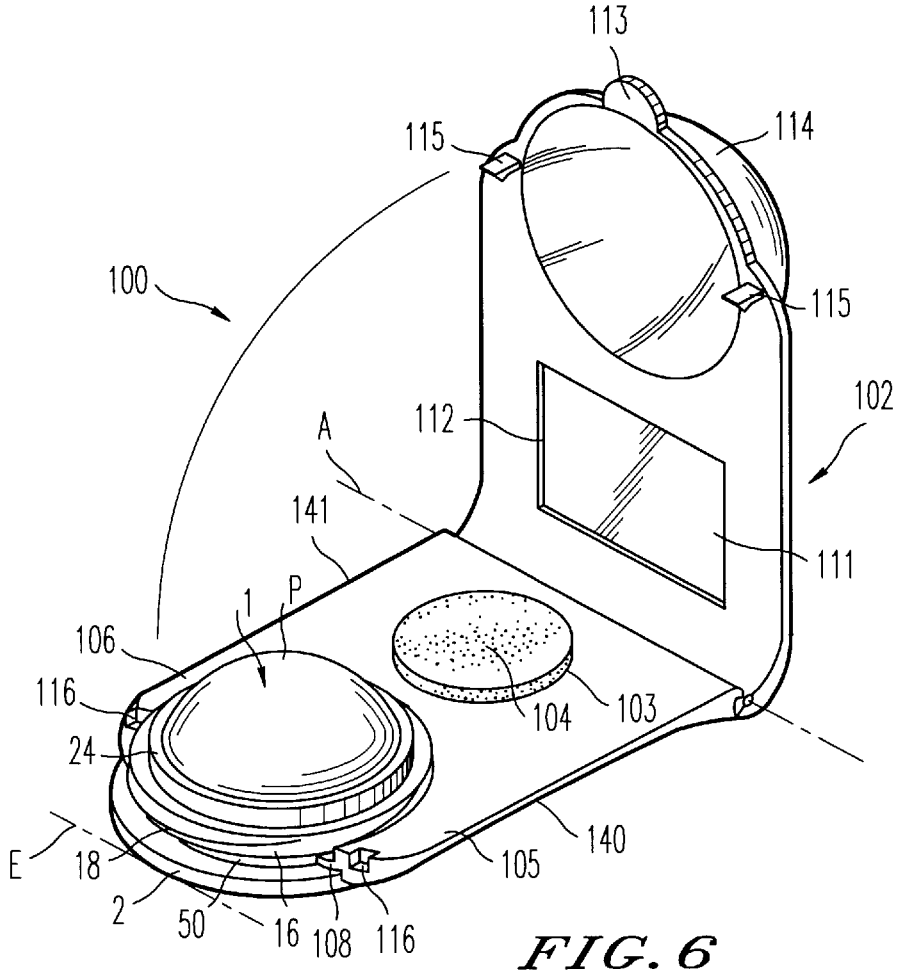
Figure 7:
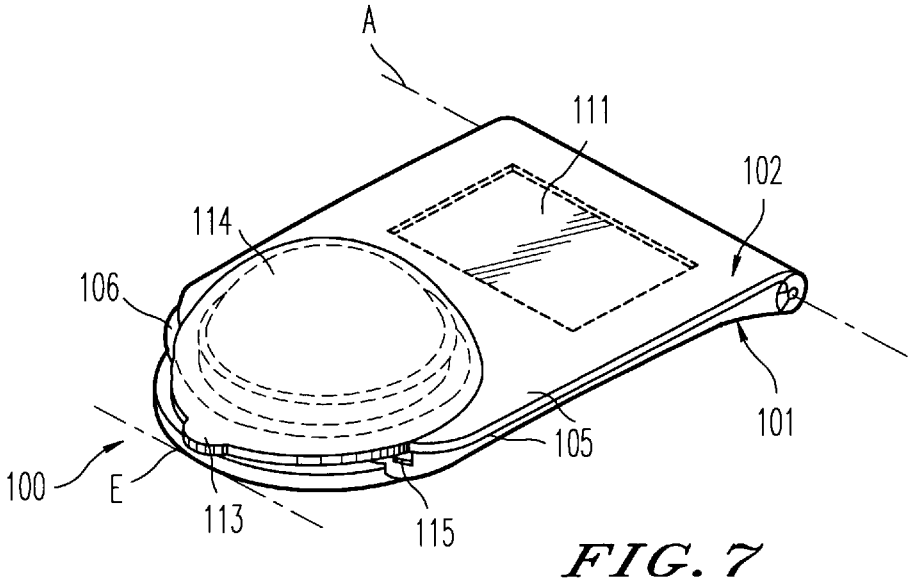

According to the variant illustrated in FIGS. 6 and 7, the lid has two closing elements 115, one disposed on either side of the longitudinal axis B on the side edges of the lid so as to cooperate with two corresponding elements 116 carried respectively by the side edges 140, 141 of the bottom 101 in the region of the arms 105, 106. Thus, as in the embodiment of FIGS. 3 to 5, the closing means are disposed in such a way that in the closed position of the lid on the bottom, the closing system 115–116 is situated between the articulation axis A and the end E of the refill on the side remote from the axis of articulation. In actual fact, in this configuration, in the closed position of the compact the product P inside the refill 1 is partly contained (i.e., only the product contained in a portion slightly smaller than half the refill 1) beyond the closing system 115, 116 relative to the articulation axis A.

Figure 8:
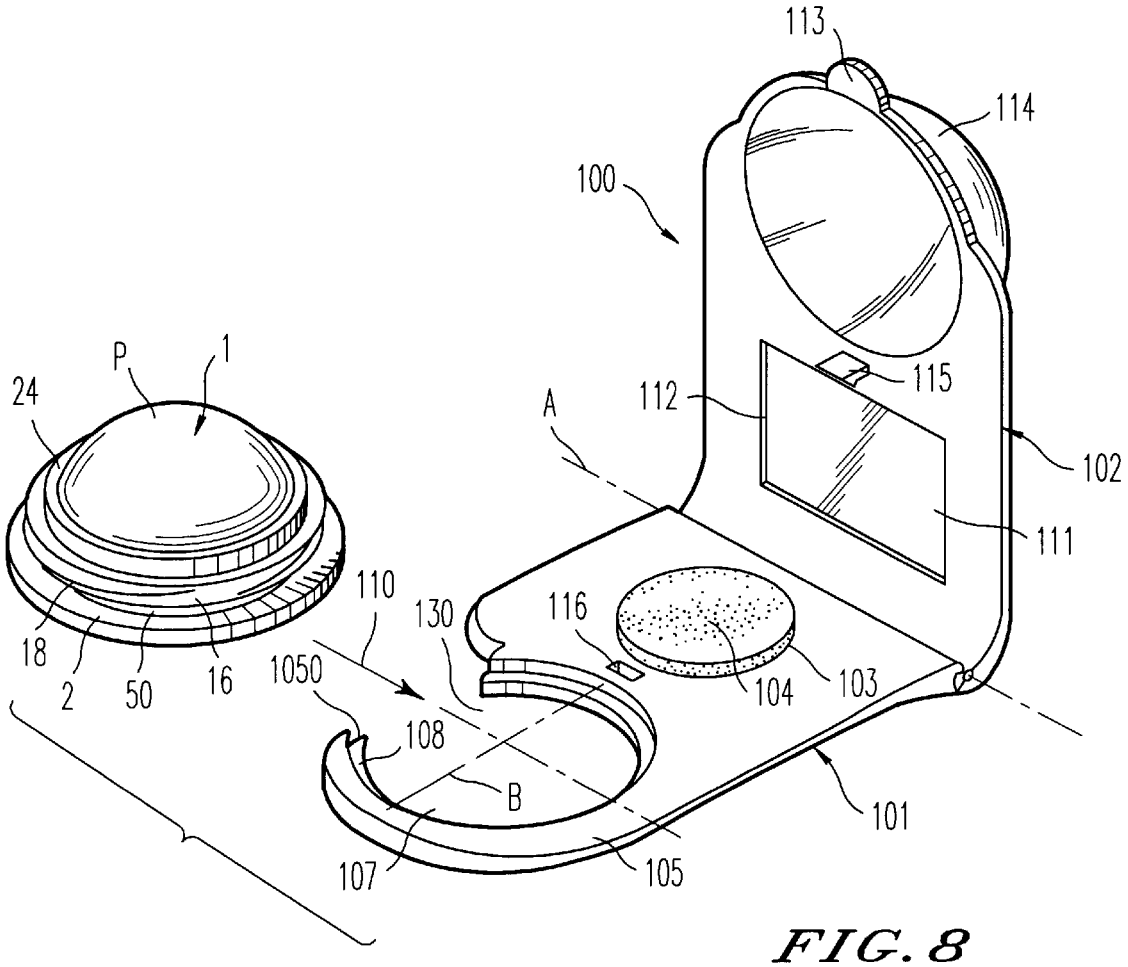
FIG. 8 shows a third embodiment of a compact in accordance with the invention.

The embodiment of FIG. 8 illustrates a variant of FIGS. 3 to 7. According to this variant, the system for the detachable mounting of the refill 1 in the compact 100 has a single arm 105 defining with the bottom 101 a circular arc-shaped cutout 107 capable of holding the refill tight over at least half its circumference in the case of a refill of a circular shape. The mouth 130 of the cutout is orientated in this configuration, substantially perpendicularly to the axis B of the compact. To mount the refill in the compact 100, one proceeds in a manner identical to that used in the embodiment of FIGS. 3 and 4, by causing the refill to slide in the direction of the arrow 110 (substantially perpendicularly to the longitudinal axis B). This causes the arm 105 to move aside by elastic deformation. The maximum deformation is reached during the passing of the greatest width of the refill. After this point of maximum deformation has passed, the arm resiliently reassumes its initial position and holds the refill tight, the rib 108 being positioned in the groove 50, and the edge of the bottom 2 of the refill being in the groove 109 of the casing. The dismounting of the refill is effected by drawing the refill in an opposite direction to the arrow 110.

In all the embodiments described above, the refill has a circular shape and the cutout is capable of holding the refill tight over at least half of its circumference. However, this characteristic depends largely on the shape of the refill, the essential condition being that the insertion of the refill in the compact is effected by elastic deformation of the arms during the passing of the portion of the refill wider than the mouth 130, followed by a resilient return movement of the arms to a rest position, so as to secure the refill in the cutout.

Figures 9, 10, 11:
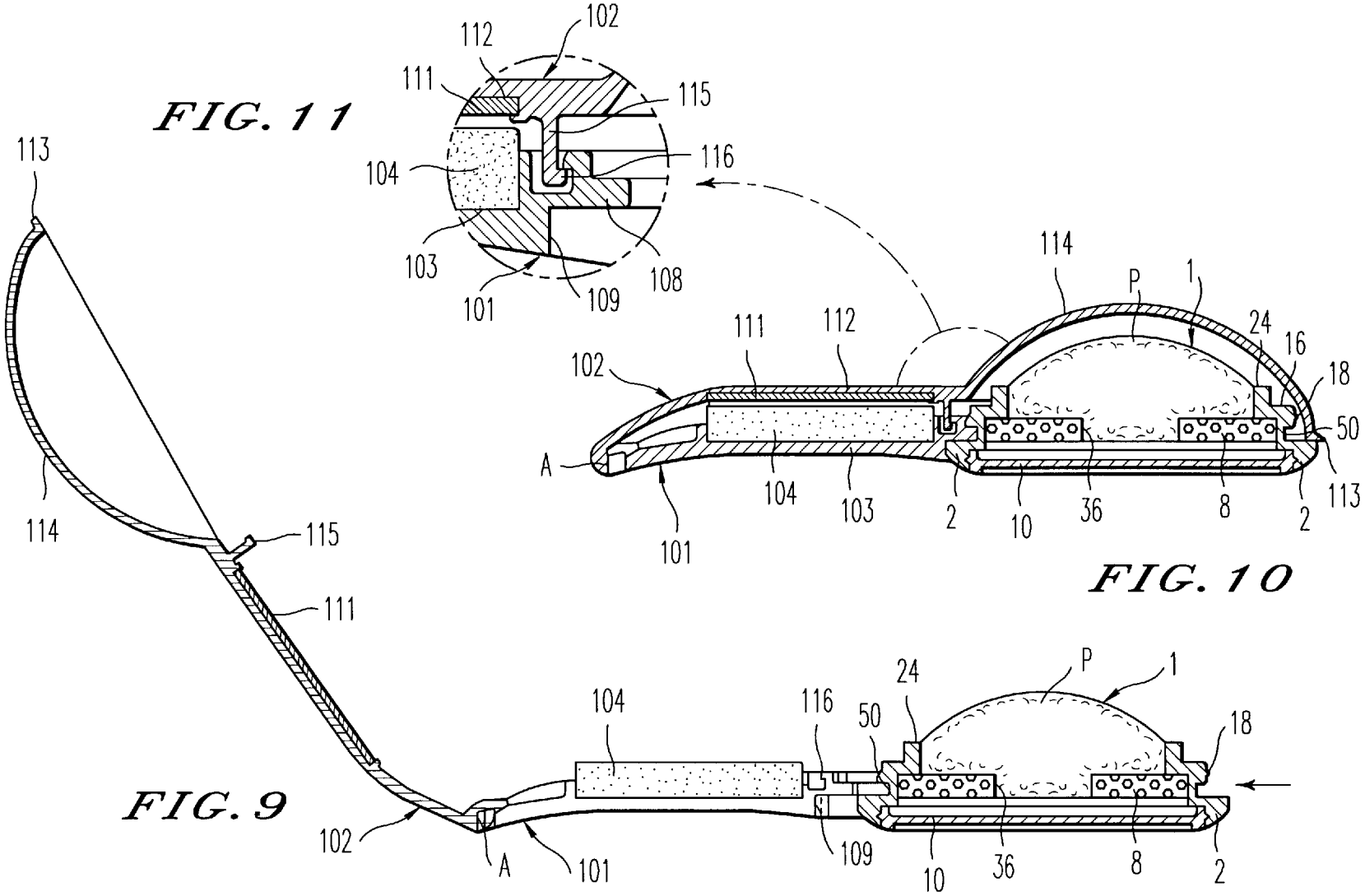
FIGS. 9 to 11 illustrate sectional views of the compact of FIGS. 3 to 5.

FIGS. 9 to 11 illustrate various sectional views along axis B of the compact shown in FIGS. 3 and 4. These Figures do not require any additional detailed description, apart from the detail of the closing system shown in FIG. 11. As is clearly shown in FIG. 11, the closing system of this embodiment has a tab 115 carried by the lid and disposed in a plane parallel to the articulation axis A and perpendicular to the plane of the lid. This tab 115 ends at its free end in a fastening edge disposed parallel to the plane of the lid and orientated away from the articulation axis A. The bottom 101 also has a tab 116 in a plane parallel to the articulation axis A and perpendicular to the plane of the bottom. This tab 116 ends in a fastening edge disposed parallel to the plane of the bottom and orientated towards the articulation axis A. During the closing of the lid on the bottom, the tabs 115, 116 are deformed by elastic deformation so as to allow the fastening edge of the tab 115 to pass beneath that of the tab 116, the tabs 115 and 116 then elastically reassuming their initial position. The lid is thus held locked on the bottom. To open the compact, the lid is pulled relative to the bottom (substantially perpendicularly to the plane of the bottom), which produces the disengagement of the fastening edge of the tab 115 by the elastic deformation of the tabs 115 and 116. The other parts of the compact have been described in detail with reference to FIGS. 3 and 4.

The compact which has been described above is particularly advantageous in that it embodies a unit that can be economically made, is reliable and is aesthetically pleasing. The assembly/disassembly of the refill is simple and retains all its efficiency and accuracy, even after many uses. Thanks to its closing system which is independent of the closing system of the compact, the refill can be sold, carried and used on its own, The closing system of the compact, although inexpensive, remains reliable in the course of use, even after many refills.

In the preceding description, reference has been made to preferred embodiments of the invention. It is obvious that variants can be introduced into it, without departing from the spirit of the invention as claimed below.

I claim:

1. A make-up casing comprising:

a lid;

a removable cartridge; and a bottom associated with the lid and having at least one elastically deformable arm disposed substantially parallel to a plane of the bottom and delimiting, together with the bottom, a cutout in a shape complementary to the shape of the removable cartridge, the cutout having a mouth at least partly delimited by a free end of the at least one arm, so that the removable cartridge can be introduced into the cutout through the mouth and is detachably held in the cutout over at least a portion of a peripheral edge thereof by the resilience of the at least one arm.

2. A make-up casing according to claim 1, wherein said cutout has an internal edge defining a groove capable of cooperating with a rib of the peripheral edge of the removable cartridge.

3. A make-up casing according to claim 2, wherein said groove is delimited by parallel upper and lower edges connected by a groove bottom, the upper edge forming a rib for cooperating with a groove formed in the peripheral edge of the removable cartridge.

4. A make-up casing according to claim 1, wherein the removable cartridge has a circular shape, said portion of the peripheral edge delimiting an angle of from 190° to 210°.

5. A make-up casing according to claim 1, wherein the removable cartridge has a circular shape, said portion of the peripheral edge delimiting an angle of from 195° to 205°.

6. A make-up casing according to claim 1, including a detachable auxiliary cap for covering the removable cartridge.

7. A make-up casing according to claim 6, wherein the auxiliary cap includes a thread cooperable with a corresponding thread of the removable cartridge.

8. A make-up casing compact according to claim 1, wherein said lid is articulated on the bottom around an articulation axis, and wherein said at least one elastically deformable arm comprises two arms at an end of the bottom remote from the articulation axis, said two arms extending substantially in an extension of the bottom and orientated substantially perpendicular to the articulation axis.

9. A make-up casing according to claim 8, wherein the bottom has a longitudinal axis parallel to plane of the bottom and perpendicular to the articulation axis, said closing means being, in the closed position of the lid on the bottom, substantially in the longitudinal axis.

10. A make-up casing according to claim 9, wherein the means for closing the make-up casing comprise a tab carried by the lid and directed substantially perpendicular to the surface of the lid, said tab having a flange elastically cooperable with a complementary element carried by the bottom to lock the lid on the bottom.

11. A make-up casing according to claim 1, including closing means for locking the lid on the bottom, said closing means being positioned such that, in a closed position of the lid on the bottom, the removable cartridge is situated at least partly beyond the closing means relative to the articulation axis.

12. A make-up casing according to claim 11, wherein in the closed position of the lid on the bottom, the closing means are situated between the removable cartridge and the articulation axis.

13. A make-up casing according to claim 11, including two lateral edges of the bottom substantially perpendicular to the articulation axis, the means for closing the compact being situated on or in the vicinity of at least one of the lateral edges.

14. A make-up casing according to claim 13, wherein the means for closing the compact are provided on the two lateral edges.

15. A make-up casing according to claim 14, wherein at least a portion of the lid opposite the removable cartridge is formed by a translucent material.

16. A make-up casing according to claim 1, wherein the bottom further includes a recess for receiving a puff-type applicator for said product.

17. A make-up casing according to claim 1, including a mirror mounted inside the lid.

18. A make-up casing according to claim 17, wherein the mirror is mounted on the lid inside a translucent recess, the mirror having two reflecting sides.

19. A make-up casing according to claim 18, wherein the mirror is mounted on the lid by snap-fitting.

20. A make-up casing according to claim 1, wherein the removable cartridge contains a product which is one of a cheek blusher, an eye shadow and a foundation cream.

21. A make-up casing according to claim 20, wherein the product contains hydrated gypsum ($CaSO_4 \cdot 2H_2O$).

22. A make-up casing comprising:

a lid;

a bottom associated with the lid and having at least one elastically deformable arm disposed substantially parallel to a plane of the bottom and delimiting, together with the bottom, a cutout in a shape complementary to a shape of a removable cartridge, the cutout having a mouth at least partly delimited by a free end of the at least one arm, so that a removable cartridge can be introduced into the cutout through the mouth and may be detachably held in the cutout over at least a portion of a peripheral edge thereof by the resilience of the at least one arm; and a mirror mounted inside at least one of the lid and the bottom.

23. A make-up casing according to claim 22, wherein the mirror is mounted on the lid inside a translucent recess, the mirror having two reflecting sides.

24. A make-up casing according to claim 23, wherein the mirror is mounted on the lid by snap-fitting.

25. A make-up casing comprising:

a lid;

a bottom associated with the lid and having at least one elastically deformable arm disposed substantially parallel to a plane of the bottom and delimiting, together with the bottom, a cutout in a shape complementary to a shape of a removable cartridge, the cutout having a mouth at least partly delimited by a free end of the at least one arm, so that a removable cartridge can be introduced into the cutout through the mouth and can be detachably held in the cutout over at least a portion of a peripheral edge thereof by the resilience of the at least one arm; and at least one latch element provided on said lid, said at least one latch element being able to engage at least one complementary latch element provided on said bottom or on a refill when the lid is in a closed position relative to the bottom so as to lock the lid in the closed position.

26. A make-up casing according to claim 25, wherein the bottom has a longitudinal axis parallel to plane of the bottom and perpendicular to the articulation axis, said at least one latch element being, in the closed position of the lid on the bottom, substantially in the longitudinal axis.

27. A make-up casing according to claim 25, wherein the at least one latch element comprises a tab carried by the lid and directed substantially perpendicular to the surface of the lid, said tab having a flange elastically cooperable with a complementary latch element carried by the bottom.

28. A make-up casing according to claim 25, including two lateral edges of the bottom substantially perpendicular to the articulation axis, the complementary latch element being situated on or in the vicinity of at least one of the lateral edges.

29. A make-up casing according to claim 28, wherein the complementary latch element is provided on the two lateral edges.

30. A make-up casing comprising:

a lid; and a bottom associated with the lid and having at least one elastically deformable arm disposed substantially parallel to a plane, of the bottom and delimiting, together with the bottom, a cutout in a shape complementary to a shape of a removable cartridge, the cutout having a mouth at least partly delimited by a free end of the at least one arm, so that a removable cartridge can be introduced into the cutout through the mouth and can be detachably held in the cutout over at least a portion of a peripheral edge thereof by the resilience of the at least one arm, wherein the casing further includes a recess receiving an applicator for a product.

* * * * *